US010351390B2

(12) United States Patent
Gainche et al.

(10) Patent No.: US 10,351,390 B2
(45) Date of Patent: Jul. 16, 2019

(54) ELEVATOR SYSTEM

(71) Applicants: THYSSENKRUPP ELEVATOR AG, Essen (DE); thyssenkrupp AG, Essen (DE)

(72) Inventors: Philippe Gainche, Großbettlingen (DE); Michael Kirsch, Kirchheim unter Teck (DE)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/761,134

(22) PCT Filed: Sep. 16, 2016

(86) PCT No.: PCT/EP2016/071942
§ 371 (c)(1),
(2) Date: Mar. 19, 2018

(87) PCT Pub. No.: WO2017/046310
PCT Pub. Date: Mar. 23, 2017

(65) Prior Publication Data

US 2018/0257911 A1 Sep. 13, 2018

(30) Foreign Application Priority Data

Sep. 18, 2015 (DE) ..... 10 2015 218 025

(51) Int. Cl.
*B66B 9/00* (2006.01)
*B66B 7/02* (2006.01)
*B66B 11/04* (2006.01)

(52) U.S. Cl.
CPC ..... *B66B 9/003* (2013.01); *B66B 7/02* (2013.01); *B66B 11/0407* (2013.01)

(58) Field of Classification Search
CPC ..... B66B 9/003; B66B 7/02
See application file for complete search history.

(56) References Cited

U.S. PATENT DOCUMENTS 3,658,155 A * 4/1972 Salter ..... B66B 9/00 187/270
3,759,349 A 9/1973 Sieffert
(Continued)

FOREIGN PATENT DOCUMENTS

CN 1934023 A 2/2007
CN 102229396 A 11/2011
(Continued)

OTHER PUBLICATIONS

English Translation of International Search Report issued in PCT/EP2015/071942, dated Nov. 21, 2016 (dated Nov. 29, 2016).

*Primary Examiner* — Michael A Riegelman
(74) *Attorney, Agent, or Firm* — thyssenkrupp North America, Inc.

(57) ABSTRACT

An elevator system may include at least two elevator shafts along with an elevator car with a cab and a chassis device. The cab may be mounted rotatably about a horizontal rotational axis relative to the chassis device. A vertically extending rail, along which the elevator car is movable, may be disposed in each elevator shaft. Each of the rails may include a rotatable segment such that the rotatable segments are alignable with respect to one another so that the elevator car is movable along the segments between the elevator shafts. A first device may lock the cab relative to the chassis device, and a second device may hold the cab relative to the elevator shafts.

13 Claims, 5 Drawing Sheets

(56) References Cited

U.S. PATENT DOCUMENTS

| | | | | |
|---|---|---|---|---|
| 3,896,736 | A * | 7/1975 | Hamy | B66B 9/003 104/127 |
| 4,004,654 | A * | 1/1977 | Hamy | B66B 9/003 104/127 |
| 5,235,144 | A * | 8/1993 | Matsui | B66B 9/003 187/250 |
| 5,547,059 | A * | 8/1996 | Watanabe | B66B 5/18 187/288 |
| 6,189,657 | B1 * | 2/2001 | Jessenberger | B66B 11/0407 187/289 |
| 6,354,404 | B1 * | 3/2002 | Sansevero | B66B 9/003 187/249 |
| 9,248,994 | B2 * | 2/2016 | Grundmann | B66B 9/00 |
| 9,598,265 | B1 * | 3/2017 | Jacobs | B66B 9/003 |
| 2006/0163008 | A1 * | 7/2006 | Godwin | B66B 9/00 187/288 |
| 2007/0199770 | A1 * | 8/2007 | Kocher | B66B 11/0407 187/277 |
| 2011/0132693 | A1 * | 6/2011 | Altenburger | B66B 9/00 187/240 |
| 2017/0088396 | A1 * | 3/2017 | Fargo | H02K 41/031 |
| 2017/0107080 | A1 * | 4/2017 | Steinhauer | B66B 9/003 |
| 2017/0225927 | A1 * | 8/2017 | Kirsch | B66B 11/0407 |
| 2017/0305718 | A1 * | 10/2017 | Finschi | B66B 1/2433 |
| 2017/0320706 | A1 * | 11/2017 | Steinhauer | B66B 5/18 |
| 2017/0327345 | A1 * | 11/2017 | Steinhauer | B66B 11/0407 |
| 2017/0355553 | A1 * | 12/2017 | Steinhauer | B66B 5/0031 |
| 2017/0369280 | A1 * | 12/2017 | Roberts | B66B 5/286 |
| 2018/0009632 | A1 * | 1/2018 | Roberts | B66B 11/0407 |
| 2018/0009633 | A1 * | 1/2018 | Fargo | B66B 19/002 |
| 2018/0009636 | A1 * | 1/2018 | Jedryczka | B66B 9/003 |
| 2018/0257911 | A1 * | 9/2018 | Gainche | B66B 9/003 |

FOREIGN PATENT DOCUMENTS

| | | | |
|---|---|---|---|
| CN | 104326323 | A | 2/2015 |
| DE | 102014104458 | A | 10/2015 |
| EP | 2619122 | A | 7/2013 |
| GB | 737276 | A | 9/1955 |
| JP | H0648672 | A | 2/1994 |

* cited by examiner

ELEVATOR SYSTEM

CROSS REFERENCE TO RELATED APPLICATIONS

This application is a U.S. National Stage Entry of International Patent Application Ser. No. PCT/EP2016/071942, filed Sep. 16, 2016, which claims priority to German Patent Application No. DE 10 2015 218 025.5, filed Sep. 18, 2015, the entire contents of both of which are incorporated herein by reference.

FIELD

The present disclosure generally relates to elevators, including elevator systems and methods for operating elevator systems that have at least two vertical elevator shafts and at least one elevator car.

BACKGROUND

Elevator cars are for the most part limited to a specific elevator shaft in elevator systems and for the most part are only able to be moved inside said elevator shaft. Elevator systems in which elevator cars can be changed over between different elevator shafts are certainly known, such a changeover, however, is linked for the most part to considerable expenditure.

Various elements for moving the elevator car are arranged for the most part in an elevator shaft, for example drives, carrier cables or guide rails. If an elevator car is to be changed over from a first elevator shaft to a second elevator shaft, the elevator car is first of all separated from all such elements in the first elevator shaft, is transported from the first elevator shaft into the second elevator shaft and connected to the corresponding elements in the second elevator shaft. Transporting the elevator car between elevator shafts, in this case, is only possible for the most part by means of costly mechanisms.

Such a changeover of elevator cars is consequently linked to great expenditure and is time-consuming. Where applicable, the entire elevator system has to be put out of operation during the changeover.

It is consequently desirable to make it possible for elevator cars to switch between elevator shafts in a low-cost, flexible manner.

One possible way to do this is shown in JP H06-48 672 A which discloses a changeover between elevator shafts by means of rotatable rail elements. In addition, DE 10 2014 104 458 A1, which was subsequently published after the priority date, describes an elevator system with two elevator shafts. The elevator car is movable between two shafts by means of a rotatable segment.

Thus a need exists for an elevator system that makes it possible for passengers to be transported in a trouble-free, comfortable manner.

DETAILED DESCRIPTION

Figure 1:
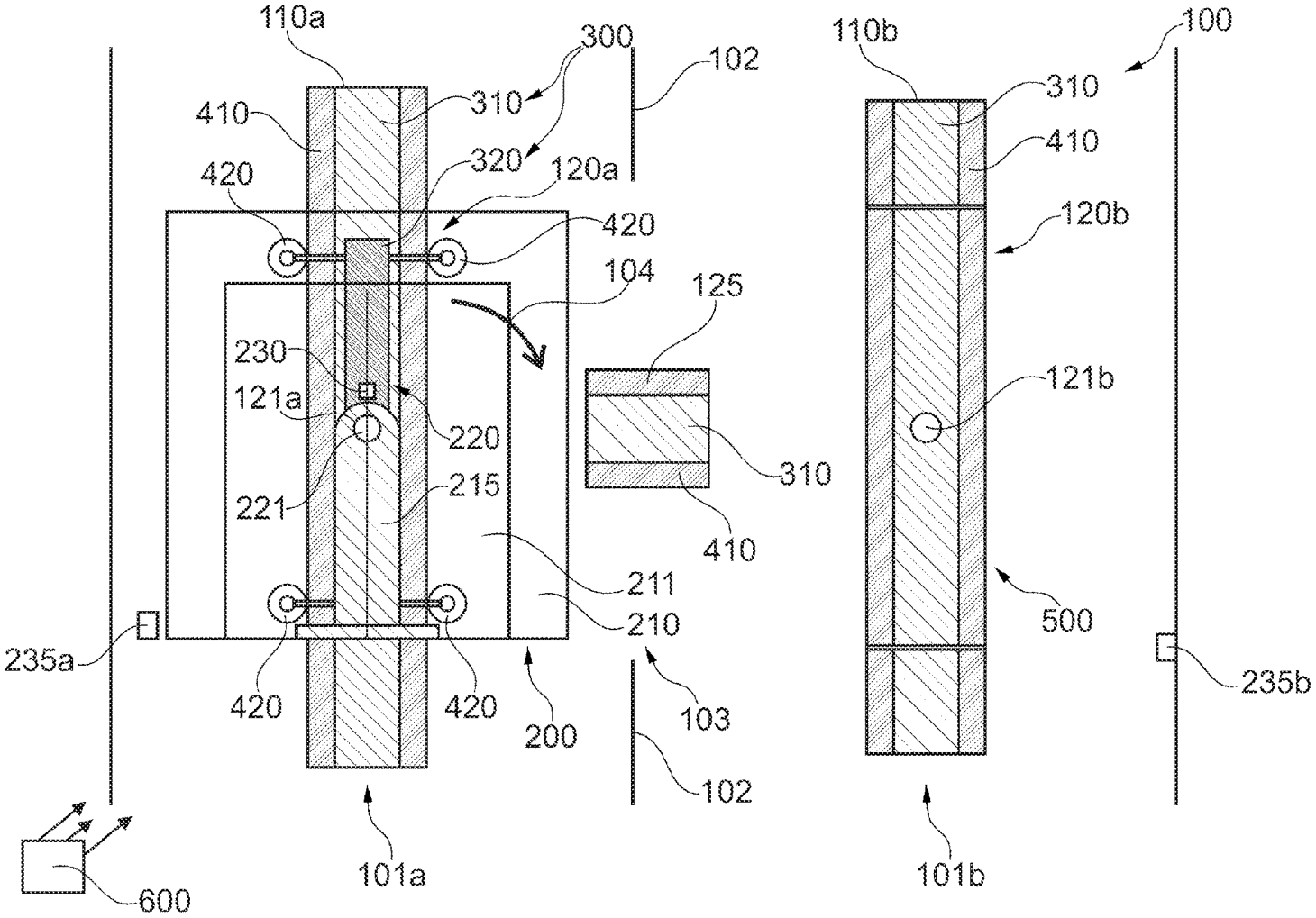
FIG. 1 is a schematic view of an example elevator system with a cab in a first position relative to a chassis device.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

An elevator system according to the invention comprises at least two elevator shafts and at least one elevator car with a cab and a chassis device, wherein the cab is mounted so as to be rotatable about a horizontal rotational axis relative to the chassis device. A vertically extending rail, along which the elevator car is movable, is provided in each elevator shaft.

Each rail comprises at least one rotatable segment. Said rotatable segments, in this case, are alignable with respect to one another in such a manner that the elevator car is movable between the elevator shafts along the segments.

The rotatable segments are, in particular, rotatable by 90°. As a result of rotating the segments, a horizontal rail is consequently formed, along which the elevator car is moved horizontally. The segments can also be rotated further in particular by an expedient angle. An inclined rail is consequently formed, that is to say a rail which is inclined by the expedient angle relative to the elevator shaft. The elevator car is moved at an angle relative to the elevator shafts along said inclined rails. It is, thus, possible, for example, for an elevator car not only to be moved into a different elevator shaft but at the same time also onto a different floor.

The moving of the elevator car between two elevator shafts along the rotated segments is designated in the following description as the elevator car "moving horizontally". This is not to be understood as the elevator car being moved, in this case, necessarily precisely in the horizontal direction, but as the movement of the elevator car comprising at least one component in the horizontal direction.

In addition, the elevator system comprises a first device which is set up for the purpose of locking the cab of the elevator car relative to the chassis device, and a second device which is set up for the purpose of holding the cab in position relative to the elevator shaft.

The first device ensures that the elevator cabs do not rotate in an unwanted manner relative to the chassis device during the run along an elevator shaft or during the run between two elevator shafts. In particular, this prevents the cabs tilting, for example, on account of a shift in the center of gravity when the passengers embark or alight. This also avoids the cab being set into a pendulum movement during the run. The passengers consequently continue to have the impression of a comfortable, smooth run.

The second device ensures that the cab maintains a stable position even during the rotating of the rotatable segment and of the chassis device about the horizontal rotational axis relative to the cab. The passenger consequently experiences comfortable, smooth transportation even in the case of said part of the run.

The first device is realized, in particular, for the purpose of locking the cab in a first position and in a second position relative to the chassis device. The first position of the cab relative to the chassis device, in this case, enables mobility along an elevator shaft. The second position of the cab relative to the chassis device enables mobility between the elevator shafts. The advantage of this is that one single device (the first device) makes possible both a trouble-free run along an elevator shaft (first position) and a trouble-free run between elevator shafts (second position). The number of moving components is consequently reduced compared to a realization with two devices for the two different positions. Consequently, the elevator system according to the invention is less susceptible to faults and is consequently low-maintenance.

It is also obviously possible to realize the first device in such a manner that the cab can be locked in more than two positions relative to the chassis device. For example, in order to make it possible for the cab to run vertically, horizontally and at an angle. A locking position is then provided for each angle that occurs in the direction of movement to the horizontal.

In particular, the first device comprises a first blocking element and a corresponding first engagement element. In this case, the first blocking element is movable between a locking position and a release position. An actuating device, which is connected to the first blocking element, is provided for the movement of the first blocking element. The blocking element cooperates with the engagement element in the locking position such that a movement of the blocking element and of the engagement element with respect to one another is blocked.

Said blocking can be ensured, for example, by means of positive locking, a blocking element, which is realized as a locking bar, engaging in a receiving means. The receiving means forms the engagement element in this case.

In order to realize the locking in two different positions, the following variant is useful where the first blocking element is realized as a locking bar and the first engagement element comprises at least one first corresponding receiving means and one second corresponding receiving means. In this way, in the first position the cab is lockable relative to the chassis device by the locking bar being moved into engagement with the first receiving means and in the second position it is lockable relative to the chassis device by the locking bar being moved into engagement with the second receiving means.

As an alternative to this, the blocking can also be ensured as a result of frictional locking. To this end, for example, a first blocking element, which is realized as a brake shoe, is pressed in the locking position onto a braking surface such that the brake shoe lies against the braking surface. The braking surface then forms the first engagement element. The cab is locked relative to the chassis device in this case as a result of frictional locking.

According to a preferred embodiment, the first blocking element is connected to the chassis device and the first engagement element is connected to the cab.

The second device preferably includes a second blocking element and a corresponding second engagement element, wherein the second blocking element is movable between a locking position and a release position. An actuating device, which is connected to the second blocking element, is provided for moving the second blocking element. In the locking position, the blocking element cooperates with the engagement element such that a movement of the blocking element and of the engagement element with respect to one another is blocked. In contrast to this, a certain relative movement between the second blocking element and the second engagement element is not blocked in the release position.

Said blocking can be ensured, for example, as a result of positive locking, a blocking element, which is realized as a locking bar, engaging in a receiving means. The receiving means forms the engagement element in this case.

As an alternative to this, the blocking can also be ensured as a result of frictional locking. To this end, for example, a second blocking element, which is realized as a brake shoe, is pressed in the locking position onto a braking surface such that the brake shoe lies against the braking surface. The braking surface then forms the second engagement element. The cab is locked relative to the elevator shaft in this case as a result of frictional locking.

In the case of a preferred realization variant of the elevator system, the second blocking element is connected to the elevator shaft. The advantage of this is that all the moving components of the second device and consequently also the actuating device for moving the second blocking element can be arranged on the elevator shaft. As a result, only passive components remain on the elevator cab. This is therefore particularly important as in a preferred manner the elevator cab is realized as light as possible. As the elevator system according to the invention does not include a counterweight, the entire weight of the elevator cab has to be overcome with the elevator drive. For this reason, it is particularly advantageous when as few components as possible remain on the elevator cab as this reduces the weight of the elevator cab. This requirement can be met as a result of distributing the second device such that the second blocking element is connected to the elevator shaft and the second engagement element to the elevator cab. There is also the further advantage that the actuating device for moving the second blocking element is easier to actuate as it is connected to the elevator shaft and is consequently mounted in a stationary manner.

In particular, the second device is realized for the purpose of blocking rotation of the cab about the horizontal rotational axis in just one direction of rotation. The achievement here is simply that entrainment of the cab during rotation of the chassis device about the horizontal rotational axis is prevented.

In the case of a preferred realization variant, the second blocking element is realized as an end stop which interacts with the second engagement element, which is realized as a stop surface, in order to block rotation of the cab about the horizontal rotational axis in just the one direction of rotation. Said realization is particularly simple and cost-efficient to realize as, in a particularly simple manner, part of the cab wall can serve as a stop surface.

In the case of an alternative realization variant, the second blocking element is realized as a locking bar which can be moved into engagement with the second engagement element, which is realized as an indentation, in order to block rotation of the cab about the horizontal rotational axis in both directions of rotation and thus hold the cab in position relative to the elevator shaft. This ensures a particularly secure, stable position of the cab during the changeover operation.

In a further alternative embodiment of the invention, the second device includes a rotary drive for rotating the cab about the horizontal rotational axis relative to the chassis device, which rotary drive is set up for the purpose, when the chassis device rotates about the horizontal rotational axis, of carrying out a corresponding counter rotation in order to hold the cab in position relative to the elevator shaft. In this case, the position of the cab relative to the elevator shaft when the chassis device is rotating is not fixed to the shaft wall by a mechanical coupling, but by a controlled counter rotation of the cab relative to the chassis device. The advantage of this is that no connection to the elevator shaft has to be produced and all the components can be arranged on the elevator car. As a result, it is not necessary to adjust components of the second device in a highly precise manner on the shaft wall. This reduces assembly expenditure.

In the case of a further development of said realization variant, it is also possible to dispense with the first device which is set up for the purpose of locking the cab of the elevator car relative to the chassis device. Said object can also be met by the rotary drive for rotating the cab relative to the chassis device. In said case, the elevator system includes at least two elevator shafts and at least one elevator car with a cab and a chassis device, wherein the cab is mounted so as to be rotatable about a horizontal axis relative to the chassis device. In this connection, a vertically extending rail, along which the elevator car is movable, is provided in each elevator shaft. In addition, each rail is realized with a rotatable segment, wherein the rotatable segments are alignable with respect to one another in such a manner that the elevator car is movable between the elevator shafts along the segments. Over and above this, the elevator system includes a rotary drive for rotating the cab about the horizontal rotational axis relative to the chassis device, which rotary drive is set up for the purpose, when the chassis device rotates about the horizontal rotational axis, of carrying out a corresponding counter rotation in order to hold the cab in position relative to the elevator shaft.

As soon as the cab, for example in the case of a vertical or horizontal run, is set into pendulum movements of the elevator car about the horizontal rotational axis (for example on account of slight irregularities along the guide rails), the rotary drive is activated in a suitable manner in order to counteract the pendulum movements. The rotary drive can be operated accordingly as damping means for unwanted rotations of the cab. The rotary drive can also counteract tilting which is caused by irregular loading. As soon as a corresponding torque which would result in tilting acts on the cab, the rotary drive is actuated to generate a corresponding counter torque.

All the forces which are absorbed by the first device in the case of the first embodiment, are equalized in the case of said variant by corresponding torques of the rotary drive. In this way, the same rotary drive which serves for the purpose of carrying out a corresponding counter rotation when the chassis device rotates about the horizontal rotational axis, can act as a locking device in the case of normal runs.

The invention additionally relates to a method for operating an afore-described elevator system including the following steps:

move the elevator car in an elevator shaft along the vertically extending rail to the rotatable segment whilst the cab of the elevator car is locked relative to the chassis device by means of the first device fix the cab relative to the elevator shaft by means of the second device release the first device rotate the rotatable segment and the chassis device relative to the cab about the horizontal rotational axis lock the cab relative to the chassis device by means of the first device release the second device move the elevator car along the segments between the elevator shafts whilst the cab of the elevator car is locked relative to the chassis device by means of the first device.

Said sequence of method steps ensures that the cab is secured at all times by means of one of the two devices. An expedient computer, in particular a control device of an elevator system, is set up, in particular with program technology, for the purpose of carrying out a method according to the invention. To this end, the control device is connected in a signaling manner to, among other things, the first device and the second device.

It is obvious that the features named above and the features yet to be named below are not only usable in the respectively specified combination, but also in other combinations or standing alone without departing from the framework of the present invention.

Figure 2:
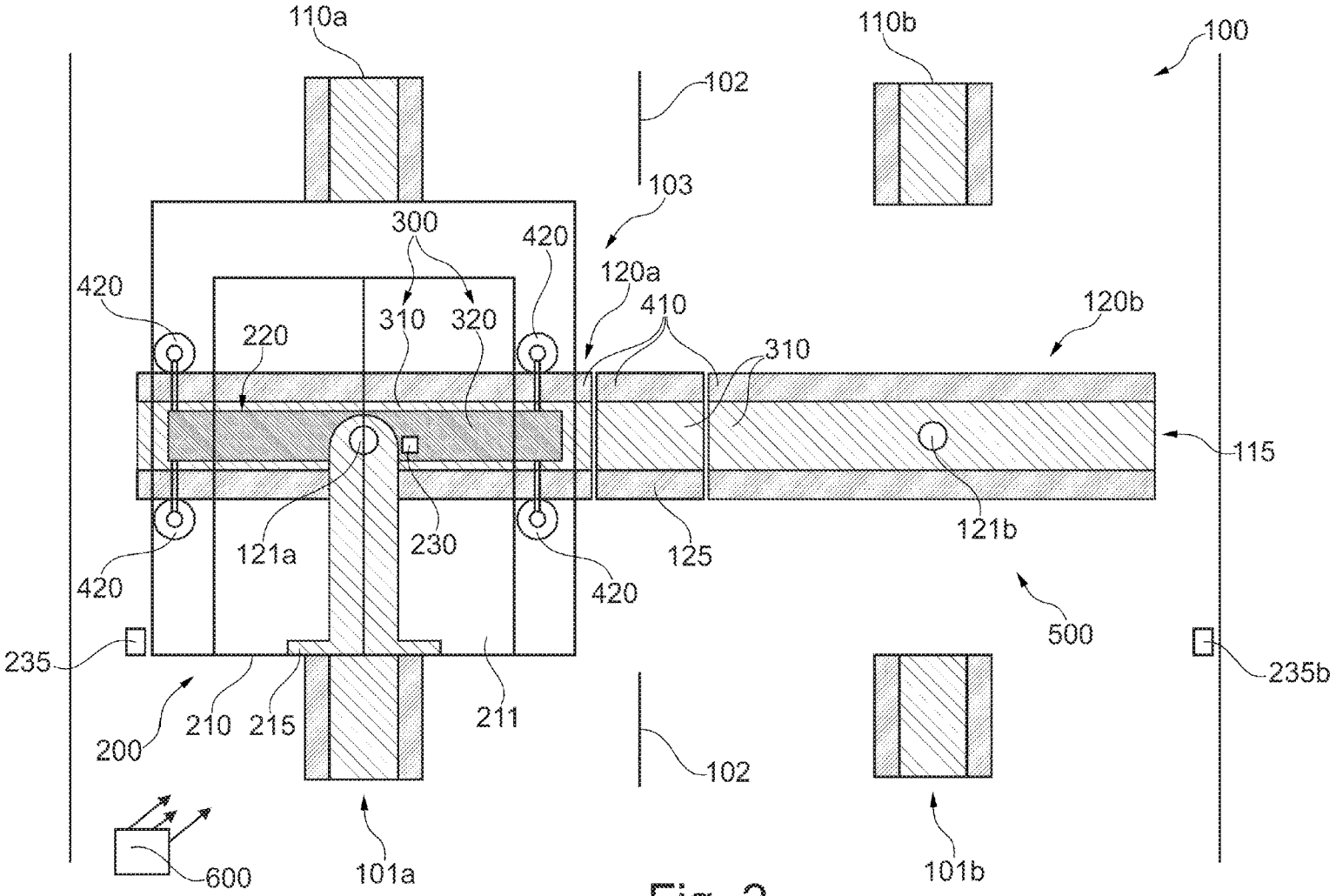
FIG. 2 is a schematic view of an example elevator system with a cab in a second position relative to a chassis device.

FIGS. 1 and 2 show a schematic representation of a preferred configuration of an elevator system according to the invention which is designated with the reference 100. The elevator system 100 includes two elevator shafts 101*a* and 101*b*. A physical barrier 102, for example a partition or a wall, can be realized, at least in part, between the elevator shafts 101*a* and 101*b*. However, it is also possible to dispense with a physical barrier 102 between the elevator shafts 101*a* and 101*b*.

A first rail 110*a* is arranged in a first elevator shaft 101*a*, a second rail 110*b* is arranged in a second elevator shaft 101*b*. An elevator car 200, which is situated in the elevator shaft 101*a* or 101*b*, is movable along said rails 110*a* or 110*b*.

The elevator car 200 includes a cab 210 and a frame or chassis device 220. The chassis device 220 functions as suspension means for the cab 210. The cab 210 is designed as so-called rucksack suspension and comprises an L-shaped carrier structure 215. In this connection, the carrier structure 215 absorbs the weight of the cab 210 through its short leg. The long leg of the L-shaped carrier structure 215, in contrast, is connected to the first rail 110*a* by means of the chassis device 220. The advantage of said rucksack realization is that the rail is only necessary on one side of the cab 210.

The chassis device 220 is connected to the cab 210 by means of a horizontal rotational axis 121*a*. The cab 210, in this case, is mounted so as to be rotatable about the horizontal rotational axis 121*a* relative to the chassis device 220. The cab 210 can be locked on the chassis device 220 by means of the first device 230, no rotation of the chassis device 220 about the horizontal rotational axis 121*a* being able to be effected in said locked state.

The elevator car 200 is movable along the rails 110*a* or 110*b* by means of a linear drive 300. The rails 110*a* or 110*b*, in this case, form a first element 310 of said linear drive 300. Said first element 310, in this case, is realized, in particular, as a primary part or as a stator 310 of the linear drive 300, especially as a longitudinal stator.

A second element 320 of the linear drive 300 is arranged on the chassis device 220 of the elevator car 200. Said second element 320 is realized, in particular, as a secondary part or a reaction part of the linear drive 300. The second element 320 is realized, for example, as a permanent magnet.

The rails 110*a* and 110*b* are not only realized as a first element 310 of the linear drive 300, but at the same time also as guide rails for the elevator car 200. The rails 110*a* or 110*b* comprise in particular, a suitable guide element 410 for this purpose. Guide rollers 420, which are realized on the chassis device 220 of the elevator car 200, engage said guide element 410.

The elevator car 200 comprises a rucksack suspension means. The chassis device 220 and the rails 110*a* or 110*b* are arranged on one side, in particular on a rear side, of the elevator car 200. Said rear side, in this case, is located opposite an entry side of the elevator car 200. The entry side of the elevator car 200 comprises a door 211. As the rails 110*a* or 110*b* function both as guide rails and as part of the linear drive 300, no additional elements are essentially required in the elevator shafts 110*a* or 110*b* to move the elevator car 200. According to the invention, the elevator car 200 is not restricted to only being moved inside one of the elevator shafts 110*a* or 110*b* but is able to be moved between the two elevator shafts 110*a* and 110*b*.

A control device 600, which is shown in a purely schematic manner in the figures, is set up, in particular with program technology, for the purpose of carrying out a preferred embodiment of a method according to the invention for operating the elevator system 100. The control device 600, in this case, actuates, in particular, the linear drive 300 and moves the elevator car 200. In addition, the control device 601 controls the changing or moving of the elevator car 200 between the elevator shafts 110*a* and 110*b*.

By way of FIGS. 1 and 2, it is described below, as an example, that the elevator car 200 is first of all moved in the elevator shaft 101*a* and is then transferred from the first elevator shaft 101*a* into the second elevator shaft 101*b*.

A change between the elevator shafts 101*a* and 101*b* is effected, in this case, in particular, in the changeover plane 500. In the region of said changeover plane 500, the barrier 102 comprises an opening 103. The elevator car 200 is able to be moved through said opening 103 between the elevator shafts 101*a* and 101*b*.

In the region of said changeover plane 500, the first rail 110*a* comprises a first rotatable segment 120*a* and the second rail 120*b* comprises a second rotatable segment 120*b*. The first segment 120*a* or the second segment 120*b* is mounted so as to be rotatable about a first horizontal rotational axis 121*a* or about a second horizontal rotational axis 121*b*. The rotatable segments 120*a* or 120*b* are also actuated by the control device 600.

The rotatable segments 120*a* and 120*b* are shown in the figures purely as an example with a rectangular form. The segments 120*a* and 120*b* can also be realized curved in the form of a circular arc at their ends at which they adjoin the remaining parts of the rails 110*a* or 110*b*. Correspondingly, the rails 110*a* or 110*b* can also be curved in the opposite direction in the form of a circular arc at points at which they adjoin the segments 120*a* or 120*b*. This consequently ensures that the segments 120*a* or 120*b* do not knock or wedge against the remaining parts of the rails 110*a* or 110*b* in the course of the rotation.

To transfer the elevator car 200 from the first elevator shaft 101*a* into the second elevator shaft 101*b*, the segments 120*a* and 120*b* are rotated from a vertical alignment, as is shown in FIG. 1, into a horizontal alignment, as is shown in FIG. 2 and is explained in more detail further below.

In addition, a compensating rail element 125 is arranged in the region of the changeover plane 500 between the rails 110*a* and 110*b*. Said compensation rail element 125 serves for bridging a space or gap between the segments 120*a* and 120*b* which have been rotated into the horizontal alignment. The compensation rail element 125 functions analogously to the rails 110*a* and 110*b* as a first element 310 of the linear drive 300 and comprises guide elements 410 in order to serve, at the same time, as a horizontal guide rail for the elevator car 200.

Analogously to the rails 110*a* or 110*b*, the compensation rail element 125 can also be realized curved in the form of a circular arc at its ends, in particular curved in the opposite direction to the corresponding ends of the segments 120*a* or 120*b*.

The elevator car 200 is first of all moved along the first rail 110*a* into the changeover plane 500 and consequently to the rotatable segment 120*a*. During said movement operation, the cab of the elevator car is locked in a first position relative to the chassis device by means of the first device 230. FIG. 1 shows that the elevator car 200 is already situated in said changeover plane 500.

The cab 210 of the elevator car 200 is then locked relative to the first elevator shaft 101*a* by means of the second device 235*a*. The first device 230 is then released. The cab 210 is then decoupled from the chassis device 220 with reference to rotations about the first horizontal rotational axis 121*a*. The chassis device 220 can then be rotated from the first position into a second position without the cab 210 also rotating at the same time.

The first segment 120*a* of the first rail 110*a* is rotated by 90° about the first horizontal rotational axis 121*a*. This is indicated by the arrow 104. In addition, the second segment 120*b* of the second rail 110*b* is rotated by 90° about the second horizontal rotational axis 121*b*. With the rotation of the first segment 120*a*, the chassis device 220 of the elevator car 200 is also rotated by 90°. As the cab 210 is locked relative to the first elevator shaft 110*a* by means of the second device 235*a*, the cab 210, in this case, remains in its alignment relative to the elevator shaft 101*a*.

FIG. 2 shows a schematic representation of the elevator system 100 analogously to FIG. 1, the first segment 120*a* and the second segment 120*b* being rotated in each case by 90° into the horizontal alignment. The cab 210 is situated in the second position relative to the chassis device 220.

As can be seen in FIG. 2, the first segment 120*a* which has now been rotated into the horizontal alignment, the second segment 120*b* which has been rotated into the horizonal alignment and the compensation rail element 125 form a horizontal rail 115. The horizontal rail 115 is a (substantially) closed rail and is realized (substantially) without a space. The cab is then locked in the second position relative to the chassis device again by means of the first device 230. The second device 235*a*, by way of which the cab 210 has been locked relative to the elevator shaft 101*a*, is then released such that the cab 210 is decoupled from the elevator shaft 101*a*.

The elevator car 200 is then moved along the horizontal rail 115. The second element 320 of the linear drive 300 on the elevator car 200 interacts, in this case, with the first element 310 of the linear drive, that is to say the horizontal rail 115 here.

The elevator car 200 can now be moved from the first elevator shaft 101*a* into the second elevator shaft 101*b* and consequently changes between the elevator shafts 101*a* and 101*b*.

Once arrived in the second elevator shaft 101*b*, said movement is carried out in an analogous manner in the reverse order. To this end, the cab 210 is locked first of all relative to the elevator shaft by means of the second device 235*b*. The first device 230 is then released and the rotatable segment 120*b* is rotated together with the chassis device 220 by 90° out of the second position back into the first position about the horizontal rotational axis 121*b*. The cab 210 is then locked in the first position relative to the chassis device 220 by means of the first device 230. The second device 235*b* is then released such that the cab 210 is decoupled from the elevator shaft 101*b* and the elevator car 200 is able to be moved in the vertical direction in the elevator shaft 101*b*.

Figure 3:
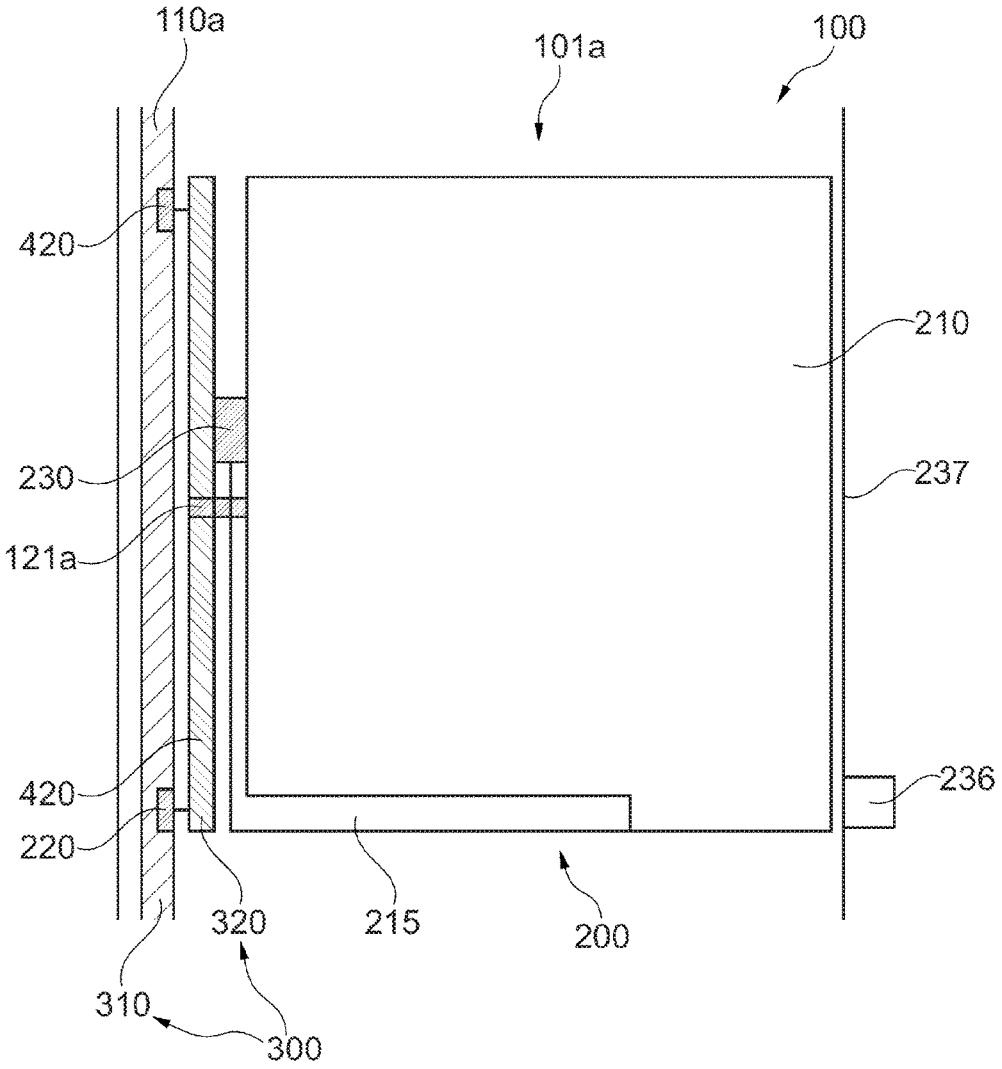
FIG. 3 is a side view of an example elevator system.

FIG. 3 shows a side view of the elevator system 100 according to the invention. The design of the elevator system 100 in this connection is substantially identical to the elevator system shown in FIG. 1. On account of the side view, the rucksack suspension means of the cab 210 can be better seen by means of the carrier structure 215 in FIG. 3. The variant shown in FIG. 3 differs only in the position of the second device 236. Whereas in FIG. 1 the second device 235*a* or 235*b* is arranged laterally with reference to the elevator cab 210, the second device 236 according to the realization according to FIG. 3 is located opposite the rear side of the elevator cab 210 on an entry side 237. In said case, the second device 236 is configured according to the description according to FIG. 8.

Figure 4:
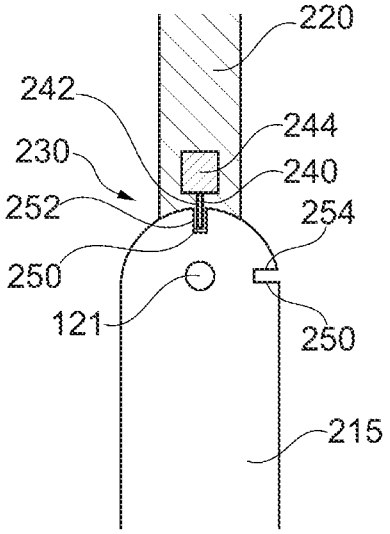
FIG. 4 is an enlarged view of a first example device with locking in a first position.
Figure 5:
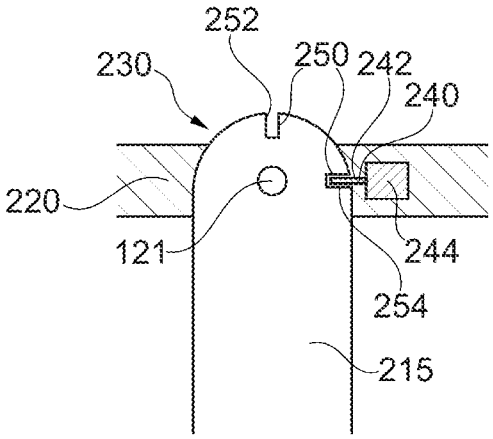
FIG. 5 is an enlarged view of a first example device with locking in a second position.

FIGS. 4 and 5 show an enlarged representation of the first device 230 in a first embodiment. In this connection, a front view analogous to FIGS. 1 and 2 has also been chosen. FIG. 4 shows the locking in the first position and FIG. 5 shows the locking in the second position.

The first device 230 comprises a first blocking element 240 and a corresponding first engagement element 250. In the present case, the first blocking element 240 is realized as a locking bar 242. The first engagement element 250 comprises a first corresponding receiving means 252 and a second corresponding receiving means 254. The locking bar 242 can be moved between a locking position and a release position by means of the actuating device 244. The locking bar 242 is shown in the locking position in FIG. 4.

The carrier structure 215 and consequently the cab (not shown) is mounted so as to be rotatable about the rotational axis 121 relative to the chassis device 220. The locking bar 242 is fixedly connected to the chassis device 220 by means of the actuating device 244. In the locking position, the locking bar 242 engages the first receiving means 252 and thus, as a result of positive locking, prevents rotation of the chassis device 220 about the rotational axis 121 relative to the carrier structure 215. To release the locking, the locking bar 242 is pulled back by the actuating device 244 until it no longer engages the first receiving means 252. Said position is designated as the release position. The chassis device 220 is then rotatable about the rotational axis 121 relative to the carrier structure 215 and consequently to the cab.

FIG. 5 shows the position of the chassis device 220 relative to the carrier structure 215 after a rotation by 90° about the rotational axis 121. The locking bar 242 has now been moved again from the release position into the locking position, in which it engages the second receiving means 254. As a result of the positive locking engagement, rotation of the chassis device 220 relative to the carrier structure 215 and consequently to the cab is prevented.

Figure 6:
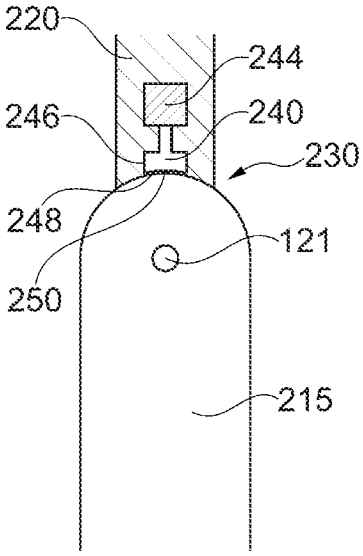
FIG. 6 is an enlarged view of a first example device in a second realization variant.

FIG. 6 shows an enlarged representation of the first device 230 in an alternative embodiment. Compared to the preceding embodiment, the first blocking element 240 is realized in the form of a brake shoe 246. In the locking position shown, the brake shoe 246 lies against a braking surface 248 of the carrier structure 215. The braking surface 248 consequently forms the first engagement element 250. The locking of the chassis device to the carrier structure 215 and consequently to the cab, is therefore ensured in this case as a result of frictional locking. The brake shoe 246 is movable away from the braking surface 248 by means of the first actuating device 244. The first device is then in the release position in said state.

Figure 7:
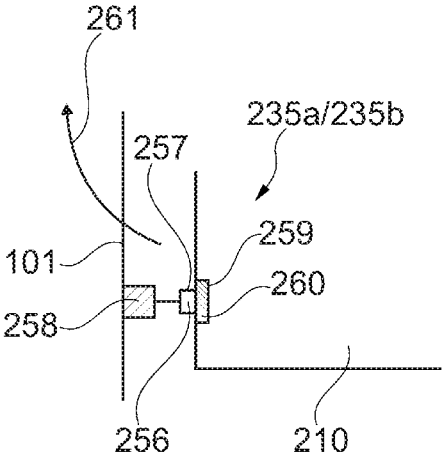
FIG. 7 is an enlarged view of a second example device in a first realization variant.

FIG. 7 shows a side view of an enlarged representation of the second device 235*a* or 235*b*. The second device comprises a second blocking element 256 and a second actuating device 258. The second blocking element 256 is realized as an end stop 257. The second blocking element 256 can be moved between a locking position and a release position by way of the second actuating element 258. In the locking position, the end stop 257 lies against the stop surface 259. The stop surface 259 forms the second engagement element 260. The end stop 257 interacts with the stop surface 259 in order to block rotation of the cab 210 about the horizontal rotational axis in just one direction of rotation 261.

The second actuating device 258 and the end stop 257 are connected to the elevator shaft 101. Consequently, all the moving components of the second device 235 are connected to the elevator shaft 101. Just the stop surface 259 remains on the elevator cab 210. As a result, all the heavy components are connected to the elevator shaft 101. This supports the lightweight construction of the elevator cab 210.

Figure 8:
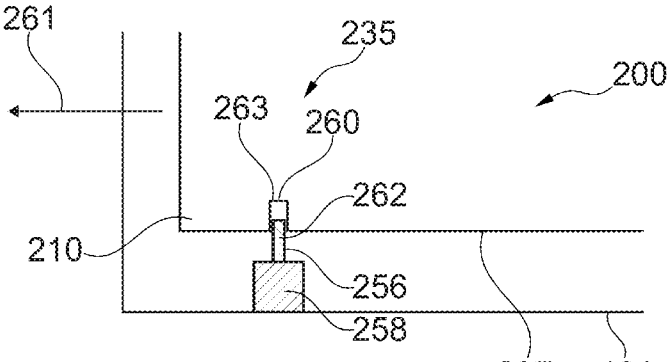
FIG. 8 is an enlarged view of a second example device in a second realization variant.
Figure 9:
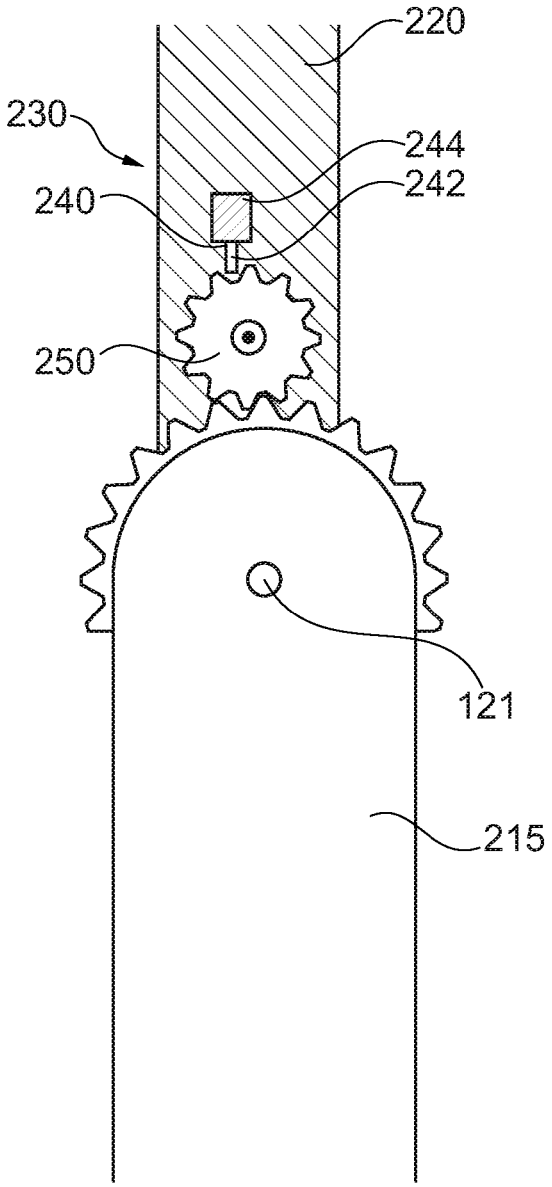
FIG. 9 is a view of a first blocking element incorporated in another embodiment of the invention.

FIG. 8 shows an enlarged representation of the second device 236 in an alternative embodiment. The figure shows a horizontal section through the elevator shaft 101. The second device 236 is arranged on an entry side 237 of the elevator car 200. The second device 236 also comprises in the case of said embodiment a second blocking element 256 and a second actuating device 258. The second blocking element 256 is realized as a locking bar 262. The locking bar 262 can be moved between a locking position and a release position by way of the second actuating element 258. In the locking position, the locking bar 262 engages the indentation 263 of the elevator cab 210. The indentation 263 forms, in this case, the second engagement element 260. The indentation 263 is arranged in the present case on the entry side of the elevator car 200. As an alternative to this, it is also possible to provide the indentation 263 on the rear side of the elevator car. The locking bar 262 interacts with the indentation 263 in order to block rotation of the cab 210 about the horizontal rotational axis in both directions of rotation as a result of positive locking. In the case of rotation of the chassis device about the horizontal rotational axis, the cab 210 would be entrained at least in part such that in the sectional plane shown there would be a movement of the cab 210 in the direction of rotation 261. Said movement is blocked as a result of the locking bar 262 engaging the indentation 263. In the case of said realization variant, a movement of the cab 210 in the opposite direction is also blocked in contrast to figure seven.

LIST OF REFERENCES

Elevator system 100
First elevator shaft 101*a*
Second elevator shaft 101*b*
Barrier 102

Opening 103
Arrow 104
First rail 110*a*
Second rail 110*b*
Horizontal rail 115
First rotatable segment 120*a*
Second rotatable segment 120*b*
First rotational axis 121*a*
Second rotational axis 121*b*
Compensation rail element 125
Elevator car
Cab 210
Door 211
Carrier structure 215
Chassis device 220
First device 230
Second device (first shaft) 235*a*
Second device (second shaft) 235*b*
Second device 236
First blocking element 240
Locking bar 242
Brake shoe 246
Braking surface 248
First actuating device 244
First engagement element 250
First receiving means 252
Second receiving means 254
Second blocking element 256
End stop
Second actuating device 258
Stop surface 259
Second engagement element 260
Direction of rotation 261
Locking bar 262
Indentation 263
Linear drive 300
First element of the linear drive 310
Second element of the linear drive 320
Guide element 410
Guide roller 420
Changeover plane 500
Control device

What is claimed is:

1. An elevator system comprising:

at least two elevator shafts;

an elevator car with a cab and a chassis device, wherein the cab is mounted so as to be rotatable about a horizontal rotational axis relative to the chassis device;

a vertically extending rail disposed in each of the at least two elevator shafts, wherein the elevator car is movable along the vertically extending rails, wherein each of the vertically extending rails comprises a rotatable segment, with the rotatable segments being alignable with respect to one another such that the elevator car is movable between the at least two elevator shafts along the rotatable segments;

a first device for locking the cab of the elevator car relative to the chassis device; and a second device for holding the cab in position relative to the at least two elevator shafts.

2. The elevator system of claim 1 wherein the first device is configured to lock the cab of the elevator car in a first position relative to the chassis device and in a second position relative to the chassis device.

3. The elevator system of claim 2 wherein the first position of the cab relative to the chassis device enables mobility along one of the at least two elevator shafts, wherein the second position of the cab relative to the chassis device enables mobility between the at least two elevator shafts.

4. The elevator system of claim 2 wherein the first device comprises a first blocking element and a corresponding first engagement element, wherein the first blocking element is movable between a locking position and a release position.

5. The elevator system of claim 4 wherein the first blocking element is a locking bar and the corresponding first engagement element comprises a first corresponding receiving means and a second corresponding receiving means such that the cab is lockable relative to the chassis device in the first position by engaging the locking bar with the first corresponding receiving means, and such that the cab is lockable relative to the chassis device in the second position by engaging the locking bar with the second corresponding receiving means.

6. The elevator system of claim 4 wherein the first blocking element is a brake shoe that lies against the corresponding first engagement element in the locking position, wherein the brake shoe comprises a braking surface such that the cab is locked relative to the chassis device by way of frictional locking.

7. The elevator system of claim 4 wherein the first blocking element is connected to the chassis device and the corresponding first engagement element is connected to the cab.

8. The elevator system of claim 1 wherein the second device comprises a second blocking element and a corresponding second engagement element, wherein the second blocking element is movable between a locking position and a release position.

9. The elevator system of claim 8 wherein the second blocking element is connected to one of the at least two elevator shafts.

10. The elevator system of claim 8 wherein the second blocking element is a locking bar that is configured to engage with the corresponding second engagement element, which is configured as an indentation, to block rotation of the cab about the horizontal rotational axis in both directions of rotation.

11. The elevator system of claim 8 wherein the second device blocks rotation of the cab about the horizontal rotational axis in only one direction of rotation.

12. The elevator system of claim 11 wherein the second blocking element is an end stop that interacts with the corresponding second engagement element, wherein the end stop comprises a stop surface for blocking rotation of the cab about the horizontal rotational axis in the only one direction of rotation.

13. The elevator system of claim 1 wherein the second device comprises a rotary drive for rotating the cab about the horizontal rotational axis relative to the chassis device, wherein when the chassis device is rotated about the horizontal rotational axis the rotary drive is configured to counter rotate the cab to hold the cab in position relative to the at least two elevator shafts.

* * * * *